United States Patent [19]

Watashi

[11] Patent Number: 5,054,769

[45] Date of Patent: Oct. 8, 1991

[54] DELIVERY UNIT ATTACHING STRUCTURE

[75] Inventor: Masahiro Watashi, Ikoma, Japan

[73] Assignee: Mita Industrial Co., Ltd., Osaka, Japan

[21] Appl. No.: 461,747

[22] Filed: Jan. 8, 1990

[30] Foreign Application Priority Data

Jan. 13, 1989 [JP] Japan ..... 1-6575

[51] Int. Cl.[5] ..... B65H 29/54

[52] U.S. Cl. ..... 271/306; 271/198; 271/207; 198/813

[58] Field of Search ..... 271/198, 200, 207, 275, 271/306, 162; 198/813-815, 578

[56] References Cited

U.S. PATENT DOCUMENTS

| | | | |
|---|---|---|---|
| 2,732,205 | 1/1956 | Dietrich et al. | 271/200 |
| 3,341,194 | 9/1967 | Bentzman | 271/200 |
| 3,921,793 | 11/1975 | Hutchinson | 198/813 |
| 3,944,213 | 3/1976 | Fallos | 271/275 |
| 4,275,876 | 6/1981 | Imaizumi | 271/207 |
| 4,570,923 | 2/1986 | Hooper et al. | 271/275 |
| 4,846,338 | 7/1989 | Widmer | 198/813 |

*Primary Examiner*—Robert P. Olszewski
*Assistant Examiner*—Steve Reiss
*Attorney, Agent, or Firm*—Antonelli, Terry, Stout & Kraus

[57] ABSTRACT

The housing of a delivery unit is engaged with a predetermined part of the body of an image forming apparatus, the housing being pivotable upwardly from the body. An endless belt is wound on a pair of pulleys. One of the pulleys is mounted on a first shaft which is secured to the housing which is latched in position on the body while the other pulley is mounted on a second shaft that is movable with respect to the housing. The second shaft is attached to the body, and the endless belit is stretched to restrain the housing from being unlatched and pivoted upwardly from the body. The delivery unit is attached without use of screws. Accordingly, the delivery unit may be readily placed in its operating position on the body with no possibility of the photoreceptor being damaged. In an image forming apparatus having electric component elements disposed under the delivery unit, the maintenance of the element is facilitated.

13 Claims, 4 Drawing Sheets

A
B
1
2
3
4
5
6
7
8
9
11
11a
12
13
14
15
16
17
18
19
20
20a
21
23
24
30
31
32
51
52

DELIVERY UNIT ATTACHING STRUCTURE

BACKGROUND OF THE INVENTION

The present invention relates to a delivery unit attaching structure for attaching to the body of an image forming apparatus a delivery unit having endless belts for delivering transfer paper from the photoreceptor of the image forming apparatus to the fixing device.

To make efficient use of office space, it has been recently desired to make the body of an image forming apparatus, such as an electrophotographic copying apparatus, in a smaller size with the functions thereof yet remaining intact. In an electrophotographic copying apparatus for example, in order to reduce the body thereof in depth, it have been proposed to dispose in the space under the delivery device which is relatively wide the electric component elements such as the power transformer, the power board and the like, which have been conventionally attached to the rear plate of the body of the copying apparatus. In this case, each time the electric component elements require maintenance, it is necessary to remove the delivery device from the body of the copying apparatus.

In a conventional delivery device using endless belts, a drive shaft and a follower shaft, respectively rotatable integrally with a pair of rollers on which the endless belts are wound, are supported, through bearings, by shaft supporting members attached to the lateral plates of the body of the copying apparatus. Accordingly, when maintaining the electric component elements in this delivery device, it is necessary to remove the endless belts, the drive shaft, the follower shaft and the like from the lateral plates of the apparatus body. Thus, the delivery unit presents a serious inconvenience to frequent maintenance.

There is also known another delivery device in which the main portions thereof are pre-assembled, as a delivery unit, in a housing, which is then screwed to the body of the copying apparatus when the same is fully assembled.

In this delivery device, the time required for maintaining the electric component elements, is slightly reduced. However, it is still necessary to carry out a screw-driving operation in a limited space in the body of the copying apparatus. This is troublesome and involves the likelihood that the photoreceptor may be damaged by a screwdriver during the screw-driving operation.

SUMMARY OF THE INVENTION

It is an object of the present invention to provide a delivery unit attaching structure which facilitates the removal and attachment of a delivery unit in an image forming apparatus and avoids damage to the photoreceptor from during removing or attaching of the delivery unit.

The object above-mentioned may be achieved by providing the following delivery unit attaching structure.

The delivery unit attaching structure for attaching, to the body of an image forming apparatus, a delivery unit having an endless belt for delivering paper, comprises:

a delivery unit housing removably engageable with a predetermined part of said body; and a pair of pulleys on which the endless belt is wound, one of the pulleys having a first shaft which is supported by the housing and of which movement relative to the housing is restrained by the housing, the other pulley having a second shaft movable with respect to the housing, the second shaft attached to the body of the image forming apparatus so that movement of the second shaft relative to the body is restrained, the second shaft being removable from the apparatus body, and the second shaft being adapted to apply tension to the endless belt to restrain the housing from being removed from the apparatus body.

According to the delivery unit attaching structure having the arrangement above-mentioned, the delivery unit may be readily attached to the body of the image forming apparatus by engaging the housing with a predetermined part of the apparatus body, with the second shaft attached to the apparatus body to apply tension to the endless belt. The tension applied to the endless belt prevents the housing from being removed from the body of the image forming apparatus. The housing may be removed from the apparatus body by removing the second shaft from the apparatus body or may be pivoted from the apparatus body by stretching the endless belt, thereby to disengage the housing from the predetermined part of the apparatus body.

Preferably, either the first shaft or the second shaft is a drive shaft for driving the endless belt. In this case, drive tension is applied to the endless belt while the endless belt is being driven. This further prevents the housing from being removed from the apparatus body.

DESCRIPTION OF THE PREFERRED EMBODIMENT

The following description will discuss in detail an embodiment of the present invention with reference to the attached drawings.

Figure 1:
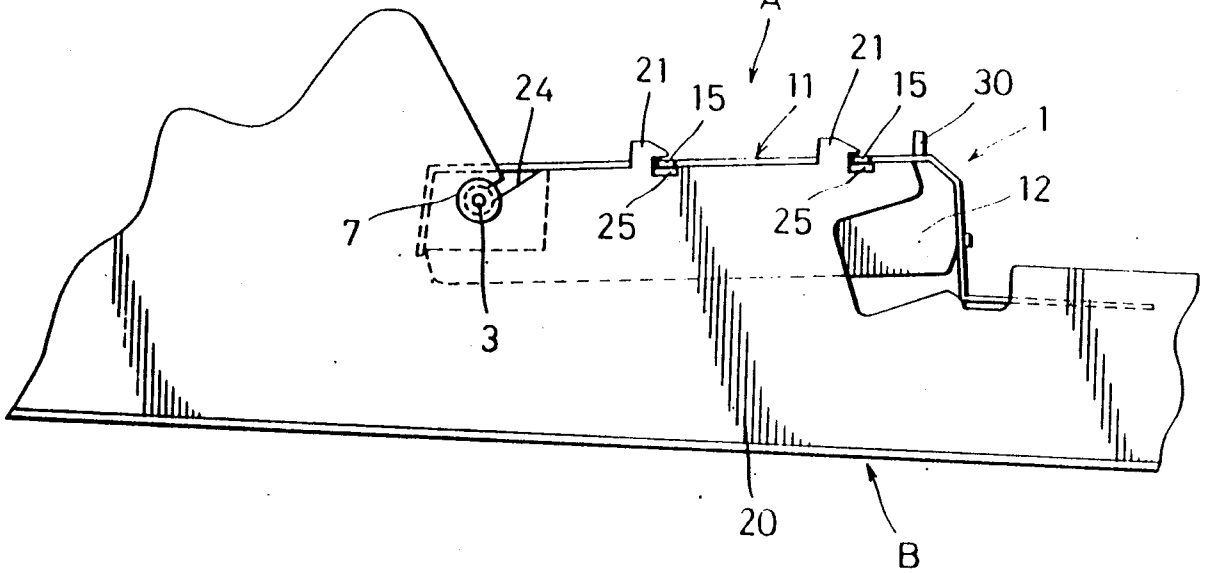
FIG. 1 is a side view of a delivery unit attached to the lateral plates of the body of an image forming apparatus.

In FIG. 1, a delivery unit A is attached to the body B of an electrophotographic copying apparatus. With such attachment, the removal of the delivery unit A from the body B is restrained by tension of endless belts 2 (FIG. 3).

Figure 3:
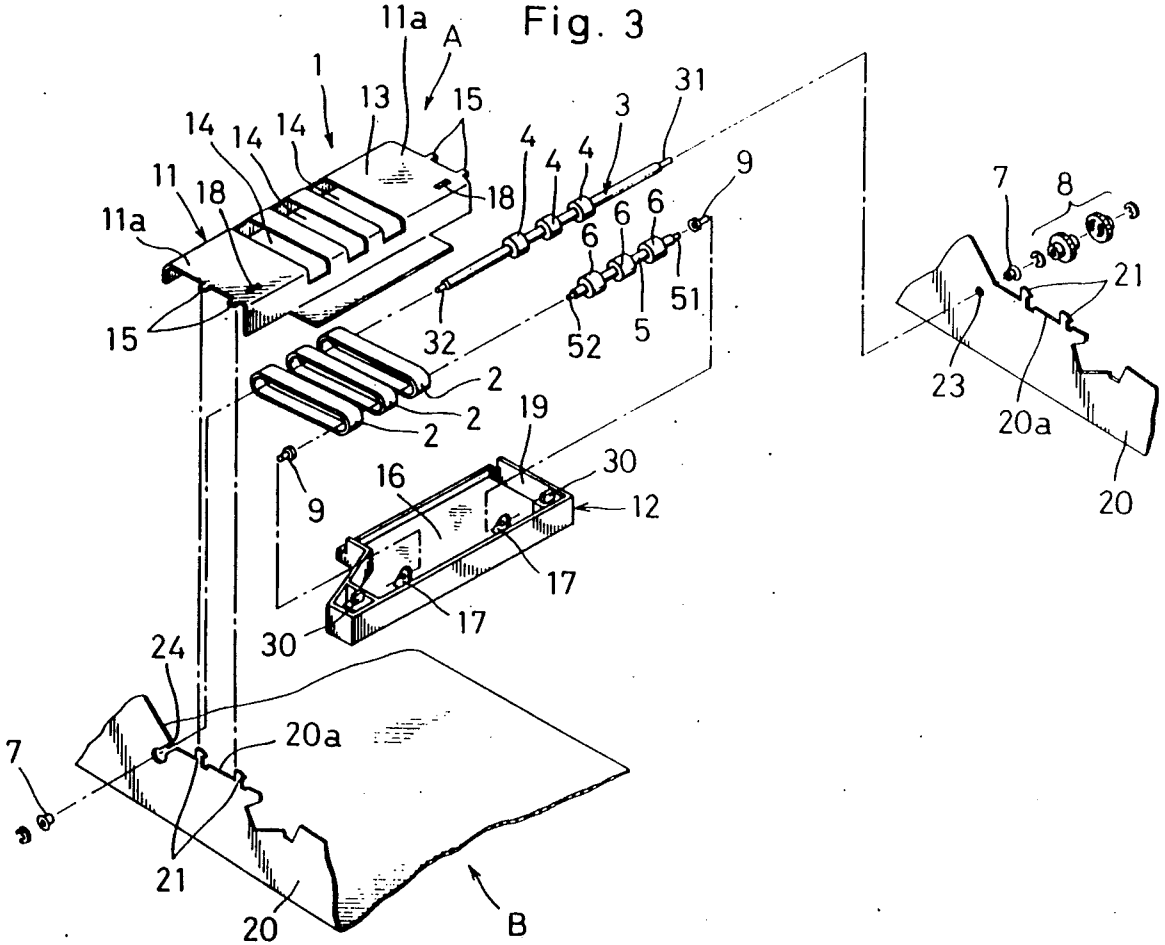
FIG. 3 is an exploded perspective view of the delivery unit.

As shown in FIG. 3, the delivery unit A includes a housing 1 having an upper housing member 11 and a lower housing member 12, a plurality of endless belts 2, pulleys 4 and 6 on which the endless belts 2 are wound, a drive shaft 3 on which the pulleys 4 are mounted, and a follower shaft 5 on which the pulleys 6 are put.

The upper housing member 11 has a longitudinal section of a substantially reversed U-shape. The upper housing member 11 is provided in the top surface 13 thereof with slits 14 through which the endless belts 2 are respectively exposed. The upper housing member 11 is provided at each end 11*a* thereof with a pair of horizontal engagement projecting pieces 15. Each of the engagement projecting pieces 15 is engageable with one of pawls 21 formed on each lateral plate 20 of the body B of the electrophotographic copying apparatus. A pair of insertion holes 18 are formed in the top surface 13 of the upper housing member 11.

The lower housing member 12 is made in the form of a container open on its upper surface, and may be assembled with the upper housing member 11. The lower housing member 12 is provided on the bottom surface 16 thereof with a pair of supporting ribs 17 to which bearings 9 are respectively attached. The supporting ribs 17 support the ends 51, 52 of the follower shaft 5 together with the bearings 9.

The lower housing member 12 has a peripheral side wall 19 which is broken around the drive shaft 3. This permits the housing to be moved relative to the drive shaft 3 and the pulleys 4 on which the endless belts 2 are wound. Both ends 31, 32 of the drive shaft 3 project outside of the housing member 1. The lower housing 12 has a pair of finger hanging projections 30 which project upwardly through the pair of insertion holes 18 of the upper housing member 11 when the lower housing member 12 and the upper housing member 11 are assembled with each other.

The housing 1 is assembled with the lower housing member 12 resiliently held by the upper housing member 11. This facilitates the assembly of the housing 1. Alternatively, the upper housing member 11 and the lower housing member 12 may be assembled together by means of screws or rivets.

Figure 2:
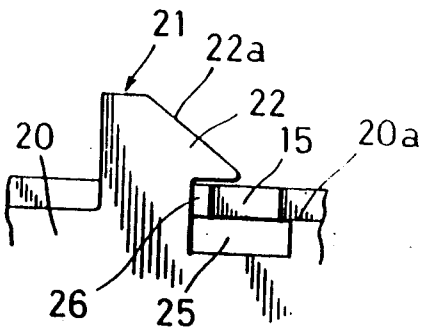
FIG. 2 is a view illustrating in detail an engagement projecting piece and a pawl engaged therewith.

The lateral plates 20 extend up from the bottom of the body B of the copying apparatus. The pair of pawls 21 above-mentioned extend vertically from the top of each lateral plate 20. In FIG. 2, each pawl 21 is provided at the right hand side thereof with a projecting portion 22. Between the projecting portion 22 and the top surface 20*a* of each lateral plate 20, there is a gap 26 in which an engagement projecting piece 15 is held. Each projecting portion 22 is provided on the upper end thereof with a guide surface 22*a* which is inclined such that it slants downward in the rightward direction. This enables the engagement projecting pieces 15 to be readily engaged with the pawls 21 by downwardly moving the engagement projecting pieces 15 along the inclined guide surfaces 22*a*. Gaps 25 are formed for engaging the engagement projecting pieces 15.

One of the lateral plates 20 has an insertion hole 23 for fixing one end 31 of the drive shaft 3 together with a bearing 7. The other lateral plate 20 has a groove 24 for fixing the other end 32 of the drive shaft 3 together with another bearing 7, the groove 24 being inclined downwardly in the leftward direction in FIG. 1. The width of the groove 24 at the inlet side is so narrow as to prevent the removal of the bearing 7 (See FIG. 3).

In this embodiment, one end 31 of the drive shaft 3 is first inserted in and fixed to the bearing 7 fitted in the insertion hole 23 in the one lateral plate 20, and the other end 32 of the drive shaft 3 is then inserted into the groove 24. In such a state, the bearing 7 is inserted into the groove 24 and is fitted to the other end 32 of the drive shaft 3, so that the other end 32 is fixed. Gears 8 for drive transmission to a drive device (not shown) are attached to one end 31 of the drive shaft 3.

Figure 4:
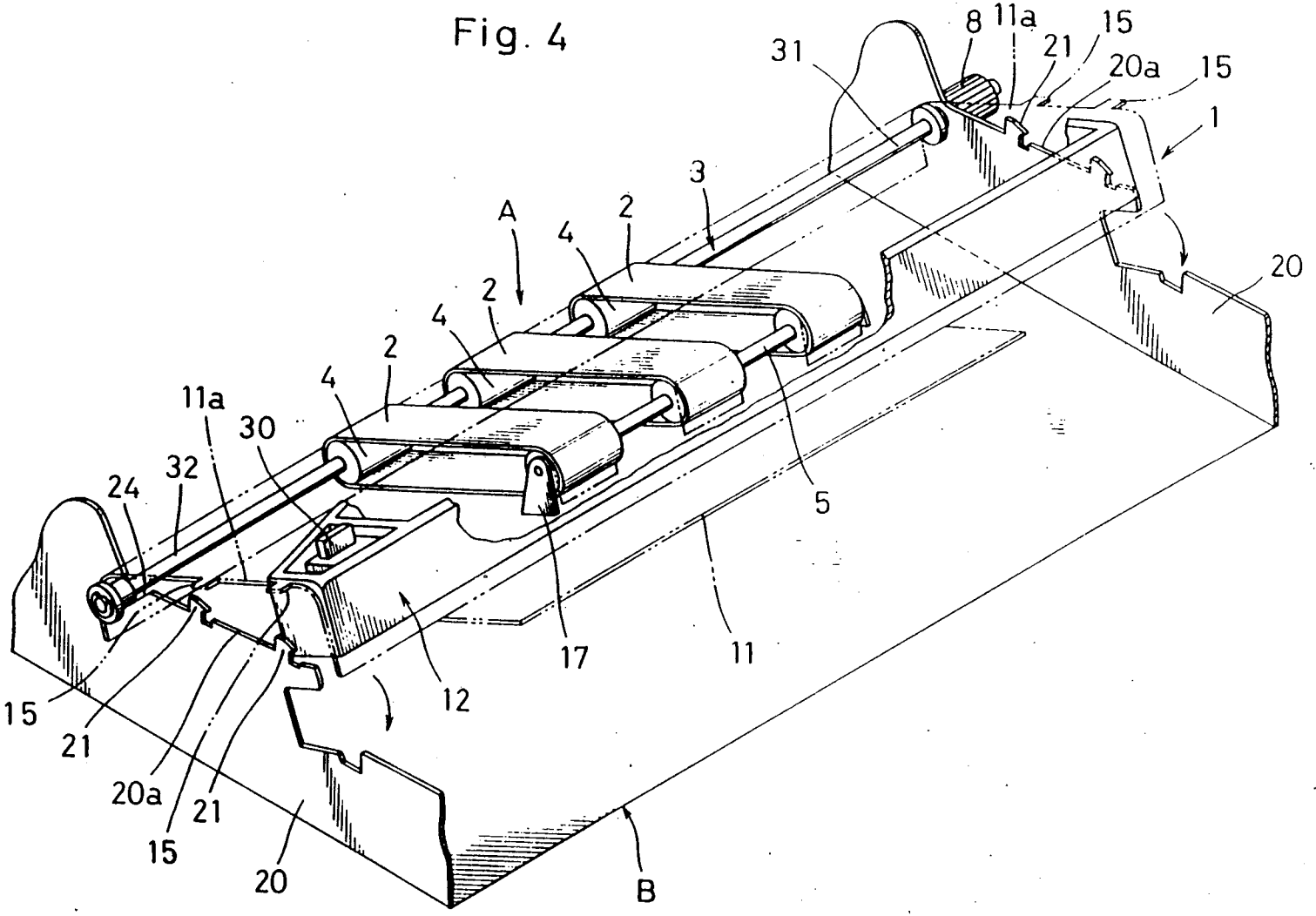
FIG. 4 is a schematic perspective view of the delivery unit as it is about to be attached.

As shown in FIG. 4, the housing 1 is downwardly pivoted around the center of the drive shaft 3 of the delivery unit A, so that the engagement projecting pieces 15 of the upper housing member 11 are respectively engaged with the pawls 21 of the lateral plates 20. Thus, the delivery unit A may be readily positioned on to the body B of the electrophotographic copying apparatus. At this time, by merely pushing down the upper housing member 11, the engagement projecting pieces 15 are moved along the inclined guide surfaces 22*a*, enabling the endless belts 2 to be tightened. Accordingly, the engagement of the engagement projecting pieces 15 with the pawls 21 may be readily made in a single operation. With such an engagement, tension is applied to the endless belts 2 so that the engagement is securely maintained. This securely prevents the housing 1 from pivoting upward from the body B of the copying apparatus.

Further, while the endless belts 2 are being driven, drive tension is applied to the endless belts 2. This further prevents the housing 1 from pivoting upward from the copying apparatus body B.

For lifting the delivery unit A from the copying apparatus body B, the housing 1 may be pulled in such a direction as to separate follower shaft 5 from the drive shaft 3 by means of the pair of projections 30 grasped by the fingers. This causes the endless belts 2 to be stretched and permits the engagement projecting pieces 15 to be disengaged from the pawls 21. Thus, the delivery unit A may be readily pivoted upward from the copying apparatus body B.

Since the delivery unit A is attached to the copying apparatus body without use of screws, the present invention overcomes the problem of conventional arrangements in which the delivery unit is screwed down, i.e., the problem that the photoreceptor may be damaged by a screwdriver.

Also, in an electrophotographic copying apparatus having electric component elements, such as the power transformer and the like, disposed under the delivery unit in order to make the apparatus body in a small size, the maintenance of the electric component elements is facilitated since the delivery unit may be readily placed in its operating position and removed from that position. Accordingly, the delivery unit attaching structure of the present invention is suitable to make the copying apparatus body in a small size.

The delivery unit attaching structure in accordance with the present invention should not be limited to the embodiment above-mentioned, but a variety of modifications of the invention may be made without departing from the scope thereof. For example, the lower housing 12 may be engaged with the bottom of the copying apparatus body B, a groove identical with the groove 24 may be used instead of the insertion hole 23, and the drive shaft 3 may be secured to the housing 1 while the follower shaft 5 is so arranged as to be movable relative to and attached to the lateral plates 20.

Further, to apply tension to the endless, belts 2, a tension roller may be disposed between the drive shaft 3 and the follower shaft 5. Such an arrangement further increases the tension applied to the endless belts 2, thereby further preventing the housing 1 from being pivoted upwardly.

Figure 5:
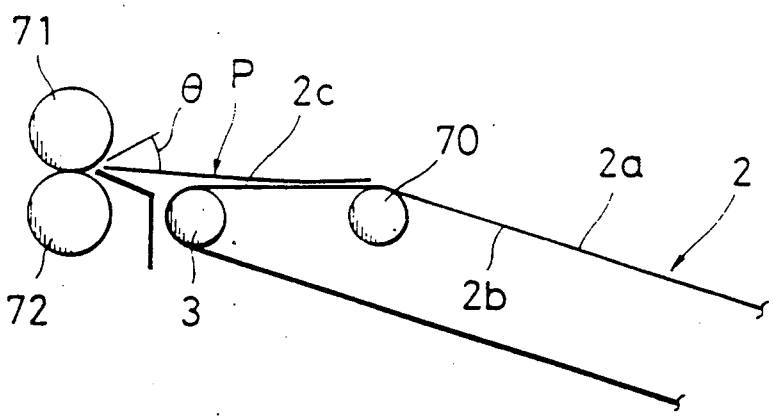
FIG. 5 is a schematic view of another example of the delivery unit.

Further, as depicted in FIG. 5, between the drive shaft 3 and the follower shaft 5 a pushing-up roller 70 may be disposed for pushing up the inner peripheral surfaces 2*b* of the endless belts 2 to make the delivery surfaces 2*a* of the endless belts 2 in the form of a mountain. According to such an arrangement, hard and short copying paper P may be smoothly introduced between a fixing roller 71 and a pressing roller 72. More specifically, the copying paper P is introduced along the front lowered portions 2*c* of the delivery surfaces 2*a* with the rear end of the paper P pushed up, i.e., with the copying paper P at a small introducing angle $\theta$ with respect to the fixing roller 71.

Further, the endless belts may be toothed, and the pulleys may be grooved.

According to the delivery unit attaching structure of the present invention, the delivery unit may be readily placed in and removed from its operating position by engaging or disengaging the housing with the body of an image forming apparatus, and there is no possibility of the photoreceptor being damaged by a screwdriver as may be done in an arrangement in which the housing is screwed to the body of an image forming apparatus. A first shaft, supporting one pulley out of a pair of pulleys on which the endless belt is wound, is fixed to the housing, while a second shaft, supporting the other pulley, is movable with respect to the housing. The second shaft is attached to the body of the image forming apparatus with tension applied to the endless belt. This assures the characteristic effect that the tension applied to the endless belt securely prevents the housing from being pivoted out of the operating position.

What is claimed is:

1. A delivery unit adapted for attaching to the body of an image forming apparatus for delivering paper to the image forming apparatus, said delivery unit comprising:

a delivery unit housing;

a first shaft rotatably mounted on said housing;

a first plurality of pulleys mounted on said first shaft for rotation therewith;

a second shaft adapted to be rotatably mounted on the image forming apparatus;

a second plurality of pulleys mounted on said second shaft for rotation therewith;

drive means for rotating one of said first shaft and second shaft;

a plurality of endless belts, each endless belt positioned around one pulley of the first plurality of pulleys and one pulley of the second plurality of pulleys so that when said second shaft is rotatably mounted on the body of the image forming apparatus, said delivery unit is pivotably mounted on the body of the image forming apparatus, and when said drive means rotates said one of said first shaft and said second shaft, said endless belts rotate;

engagement means adapted to engage with engaging means on the body of the image forming apparatus when said delivery unit is pivotably mounted on the body of the image forming apparatus, for releasably holding said delivery unit in a delivery position for delivering of paper to the image forming apparatus, with each of said endless belts tightly engaging its associated pulleys from said first and second pluralities to restrain said engagement means from disengaging from the engaging means, while allowing limited movement of said delivery unit against the restraint of said tightly engaging endless belts to a disengaged position in which said engagement means is disengaged from the engaging means, allowing said delivery unit to pivot about said second shaft to a position away from the body of the image forming apparatus.

2. A delivery unit as set forth in claim 1, wherein said housing includes an upper housing member and a lower housing member adapted to be assembled with said upper housing member.

3. A delivery unit as set forth in claim 2, wherein said engagement means comprises a pair of engagement projecting pieces formed at each end of said upper housing member.

4. A delivery unit attaching structure as set forth in claim 1, further comprising tension roller means disposed between said first and second shafts for applying tension to said endless belts.

5. A delivery unit attaching structure as set forth in claim 1, further comprising pushing-up roller means disposed between said first and second shafts for pushing up the inner peripheral surfaces of said endless belts, thereby to make the delivery surfaces of said endless belts in the form of a mountain.

6. An image forming apparatus comprising means defining an image forming body containing image forming components; and a delivery unit for delivering paper to said image forming machine body for formation of an image on the paper by said image forming components, said delivery unit comprising:

a delivery unit housing;

a first shaft rotatably mounted on said delivery unit housing;

a first plurality of pulleys mounted on said first shaft for rotation therewith;

a second shaft rotatably mounted on said image forming apparatus body;

a second plurality of pulleys mounted on said second shaft for rotation therewith;

drive means for rotating one of said first shaft and said second shaft, a plurality of endless belts, each endless belt positioned around one pulley of the first plurality of pulleys and one pulley of the second plurality of pulleys to pivotably mount said delivery unit on said image forming apparatus body, and when said drive means rotates said one of said first shaft and said second shaft, said endless belt rotates;

engaging means on the image forming apparatus body;

engagement means on said delivery unit housing and adapted to engage with said engaging means for releasably holding said delivery unit in a delivery position, for delivery of paper to said image forming apparatus, with each of said endless belts tightly engaging its associated pulleys from said first and second pluralities to restrain said engagement means from disengaging from said engaging means, while allowing limited movement of said delivery unit against the restraint of said tightly engaging endless belts to a disengaged position in which said engagement means is disengaged from said engaging means, allowing said delivery unit to pivot about said second shaft to a position away from said image forming apparatus body.

7. An image forming apparatus as set forth in claim 6, wherein said delivery unit housing includes an upper housing member and a lower housing member adapted to be assembled with said upper housing member when said delivery unit is in the delivery position.

8. An image forming apparatus as set forth in claim 7, wherein said engagement means comprises a pair off engagement projecting pieces formed at each end of said upper housing member, and wherein said engaging means comprises a pair of lateral plates extending from said image forming apparatus body, and a pair of pawls formed on said pair of lateral plates.

9. An image forming apparatus as set forth in claim 8, wherein said pawls have inclined guide surfaces for guiding said engagement projecting pieces to engage with said pawls.

10. An image forming apparatus as set forth in claim 6, wherein said image forming apparatus body includes a lateral plate having a groove formed therein and said second shaft includes an end removably engaged in said groove.

11. An image forming apparatus as set forth in claim 6, further comprising tension roller means disposed between said first and second shafts for applying tension to said endless belts.

12. An image forming apparatus as set forth in claim 6, further comprising pushing-up roller means disposed between said first and second shafts for pushing up the inner peripheral surfaces of said endless belts, thereby to make the delivery surfaces of said endless belts in the form of a mountain.

13. An image forming apparatus as set forth in claim 6 further comprising electric component elements disposed under said delivery unit when said delivery unit is in the delivery position, and accessible when said delivery unit is pivoted about said second shaft to the position away from said image forming apparatus body.

* * * * *